US012410002B2

(12) United States Patent
Vreugdenhil

(10) Patent No.: US 12,410,002 B2
(45) Date of Patent: Sep. 9, 2025

(54) EXPANDABLE VEHICLE CONTAINER

(71) Applicant: 1332006 Alberta Inc., Edmonton (CA)

(72) Inventor: John Vreugdenhil, Edmonton (CA)

(73) Assignee: 1332006 Alberta Inc., Edmonton (CA)

( * ) Notice: Subject to any disclaimer, the term of this patent is extended or adjusted under 35 U.S.C. 154(b) by 128 days.

(21) Appl. No.: 17/969,652

(22) Filed: Oct. 19, 2022

(65) Prior Publication Data

US 2023/0150759 A1 May 18, 2023

(30) Foreign Application Priority Data

Nov. 16, 2021 (CA) ..... CA 3139230

(51) Int. Cl.

| | |
|---|---|
| ***B65D 88/00*** | (2006.01) |
| ***B65D 88/54*** | (2006.01) |
| ***B65D 90/00*** | (2006.01) |
| ***B65D 90/08*** | (2006.01) |

(52) U.S. Cl.

CPC ..... *B65D 88/005* (2013.01); *B65D 88/542* (2013.01); *B65D 90/0086* (2013.01); *B65D 90/08* (2013.01); *B65D 2590/02* (2013.01)

(58) Field of Classification Search

CPC .. B65D 88/36; B65D 88/522; B65D 90/0086; B65D 2590/662; B65D 88/58; E05D 15/10; E05D 15/06

USPC ..... 220/1.5

See application file for complete search history.

(56) References Cited

U.S. PATENT DOCUMENTS

| | | | | |
|---|---|---|---|---|
| 1,740,000 | A * | 12/1929 | Andrews | B65D 90/0086 105/377.05 |
| 6,247,747 | B1 * | 6/2001 | Kawanomoto | B62D 25/2054 296/181.3 |
| 6,890,136 | B2 | 5/2005 | Heim et al. | |
| 7,021,461 | B1 | 4/2006 | Robey | |
| 9,714,137 | B2 | 7/2017 | Hamilton et al. | |
| 10,520,977 | B2 * | 12/2019 | Mittler | G07F 17/3211 |
| 10,633,908 | B1 * | 4/2020 | Loeb | E05D 15/1002 |
| 10,723,546 | B2 | 7/2020 | Wegener | |
| 2011/0297675 | A1 | 12/2011 | Johnson et al. | |
| 2014/0117010 | A1 | 5/2014 | Chuang | |
| 2019/0276226 | A1 * | 9/2019 | Havener | B65D 88/528 |

(Continued)

FOREIGN PATENT DOCUMENTS

| | | |
|---|---|---|
| AT | 11740 U1 | 4/2011 |
| DE | 2601128 | 7/1976 |

(Continued)

OTHER PUBLICATIONS

From Sliding Steel Doors website: Shipping Container Modifications; at least as early as Feb. 24, 2021; 8 pages.

(Continued)

*Primary Examiner* — Anthony D Stashick
*Assistant Examiner* — Raven Collins
(74) *Attorney, Agent, or Firm* — Lowe Graham Jones PLLC

(57) ABSTRACT

An expandable storage container comprises a floor and two longitudinal walls, each wall comprising at least one arm, with the wall connected through the arms to the floor so as to provide lateral extension of the longitudinal walls away from the floor. In certain embodiments, the arms are slideably or hingedly connected to the floor to provide lateral extension.

17 Claims, 5 Drawing Sheets

(56) References Cited

U.S. PATENT DOCUMENTS

| | | | | |
|---|---|---|---|---|
| 2019/0350407 | A1* | 11/2019 | Sharpe | A47J 37/0664 |
| 2021/0079644 | A1* | 3/2021 | Jewell | E04B 1/34336 |

FOREIGN PATENT DOCUMENTS

| | | | | |
|---|---|---|---|---|
| DE | 102016123246 | | 6/2018 | |
| EP | 2441702 | A1 * | 4/2012 | B65D 88/126 |
| EP | 2311757 | | 4/2014 | |
| ES | 2376562 | | 1/2013 | |
| WO | 2007106920 | | 9/2007 | |
| WO | 2012049231 | | 4/2012 | |

OTHER PUBLICATIONS

Photograph of Pop-Top Winnebago Solis Camper Van, at least as early as Feb. 24, 2021, 1 page.
Office Action dated Aug. 14, 2023, in Canadian Patent Application No. 3139230, 5 pages.

* cited by examiner

EXPANDABLE VEHICLE CONTAINER

PRIORITY CLAIM

This application claims priority from Canada Patent Application No. 3,139,230, filed Nov. 16, 2021, the contents of which are incorporated herein by reference.

FIELD OF THE INVENTION

Vehicle transport containers, particularly vehicle transport containers with expandable walls or openings.

BACKGROUND OF THE INVENTION

When transporting motor vehicles, it is typical to ship the vehicles in open transport systems. For example, open vehicle transport can often comprise a truck towing one or two levels of cars. A single truck might tow as many as 10 or more cars at a time. In these systems, the vehicles are exposed to the elements during transportation and there is a moderate probability of some cosmetic damage to the vehicle due to weather or debris.

An alternative to open vehicle transport is to ship vehicles in enclosed containers. A variety of such containers exist, including single vehicle containers and multi-vehicle containers, such as those disclosed in U.S. Pat. No. 6,890,136 B2.

A difficulty with enclosed vehicle transport containers is that standard-sized freight containers are relatively narrow compared to the width of a vehicle. It may be difficult for a driver to safely drive a vehicle into a container or open a vehicle door to exit the vehicle without causing damage to the vehicle.

Vehicle transport containers are also sometimes used for temporary or long term storage of vehicles. Storing a vehicle in a vehicle transport container protects it from the elements during storage and thereby avoids consequential wear and tear.

SUMMARY OF THE INVENTION

There is provided an expandable storage container comprising a floor, a front end, a rear end, and first and second side walls, the storage container having a length defined by a spacing of the front end and rear end, the length defining a depth axis, and a width defined by a spacing of the first and second side walls, the width defining a horizontal axis, the length being larger than the width; the front end comprising an end door; the first side wall comprising a first side door hingedly connected to the floor via a floor side door hinge; the first side door and the end door meeting when the expandable storage container is in a closed configuration, and when the expandable storage container is in an open configuration, the first side door and the end door opening to, with the second side wall, collectively define a single opening, the expandable storage container having a first width in a closed configuration and a second width in an open configuration, wherein the first width is smaller than the second width.

In various embodiments, one or more of the following features may be provided: the floor side door hinge connects to the first side door via a floor swing arm hingedly connected to the first side door via a further hinge defining an axis parallel to the floor side door hinge; the floor swing arm is one of plural floor swing arms connecting the first side door to the floor; the floor swing arms are equal in length and are configured to swing synchronously when the first side door is opened; the first side wall further comprises one or more additional side doors, the one or more additional side doors when closed forming together at least a portion of the first side wall without intervening fixed frame elements; a ceiling; the end door is hingedly connected to the floor or to the ceiling of the expandable storage container via an end door hinge; the first side door is hingedly connected to the ceiling via a ceiling side door hinge rotatable about the vertical axis; the floor side door hinge connects to the first side door via a floor swing arm hingedly connected to the first side door via a further hinge defining an axis parallel to the floor side door hinge, and the ceiling side door hinge connects to the first side door via a ceiling swing arm hingedly connected to the first side door via another hinge rotatable about the parallel axis; the floor swing arm and ceiling swing arm are rigidly connected; the floor swing arm is one of plural floor swing arms connecting the first side door to the floor, and the ceiling swing arm is one of plural ceiling swing arms connecting the first side door to the floor; the swing arms are equal in length and are configured to swing synchronously when the first side door is opened; the first side wall further comprises one or more additional side doors, the one or more additional side doors when closed forming together at least a portion of the first side wall without any intervening fixed frame elements; the second side wall comprises a second side door hingedly connected to the floor via a second floor side door hinge defining a second vertical axis, the second floor side door and the end door meeting when the expandable storage container is in the closed configuration, and when the expandable storage container is in the open configuration, the first side door, the second floor side door and the end door opening to collectively define a single opening; having bilateral symmetry such that all doors in the first side wall have symmetrically arranged and symmetrically opening counterparts in the second side wall; the end door is hingedly connected to the floor, and is configured to form a ramp when open to connect the floor to a ground surface.

There is provided an expandable storage container comprising a floor and two longitudinal walls. The longitudinal walls each comprising at least one arm. The walls connected through the arms to the floor so as to provide lateral extension of the longitudinal walls away from the floor.

In various embodiments, there may be included any one or more of the following features: the at least one arm is slideably connected to the floor to provide lateral extension; the at least one arm is hingedly connected to the floor to provide lateral extension.

These and other aspects of the device and method are set out in the claims.

BRIEF DESCRIPTION OF THE DRAWINGS

Embodiments will now be described with reference to the figures, in which like reference characters denote like elements, by way of example, and in which.

DETAILED DESCRIPTION OF THE PREFERRED EMBODIMENT

Figure 1:
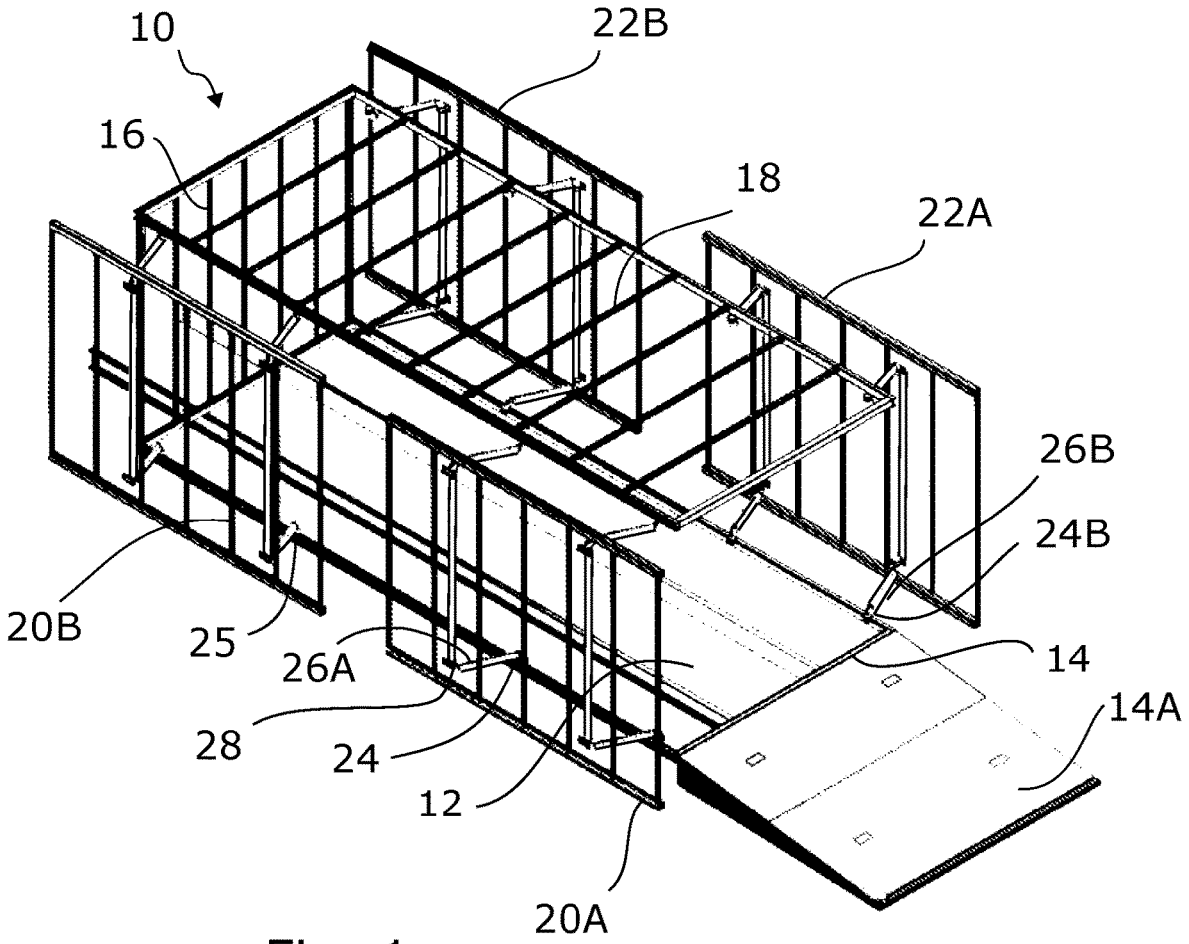
FIG. 1 is a perspective view of an embodiment of an expandable storage container in which the side doors have been opened to expand the width of the expandable storage container, shown with transparent side doors and ceiling for illustrative purposes.
Figure 2:
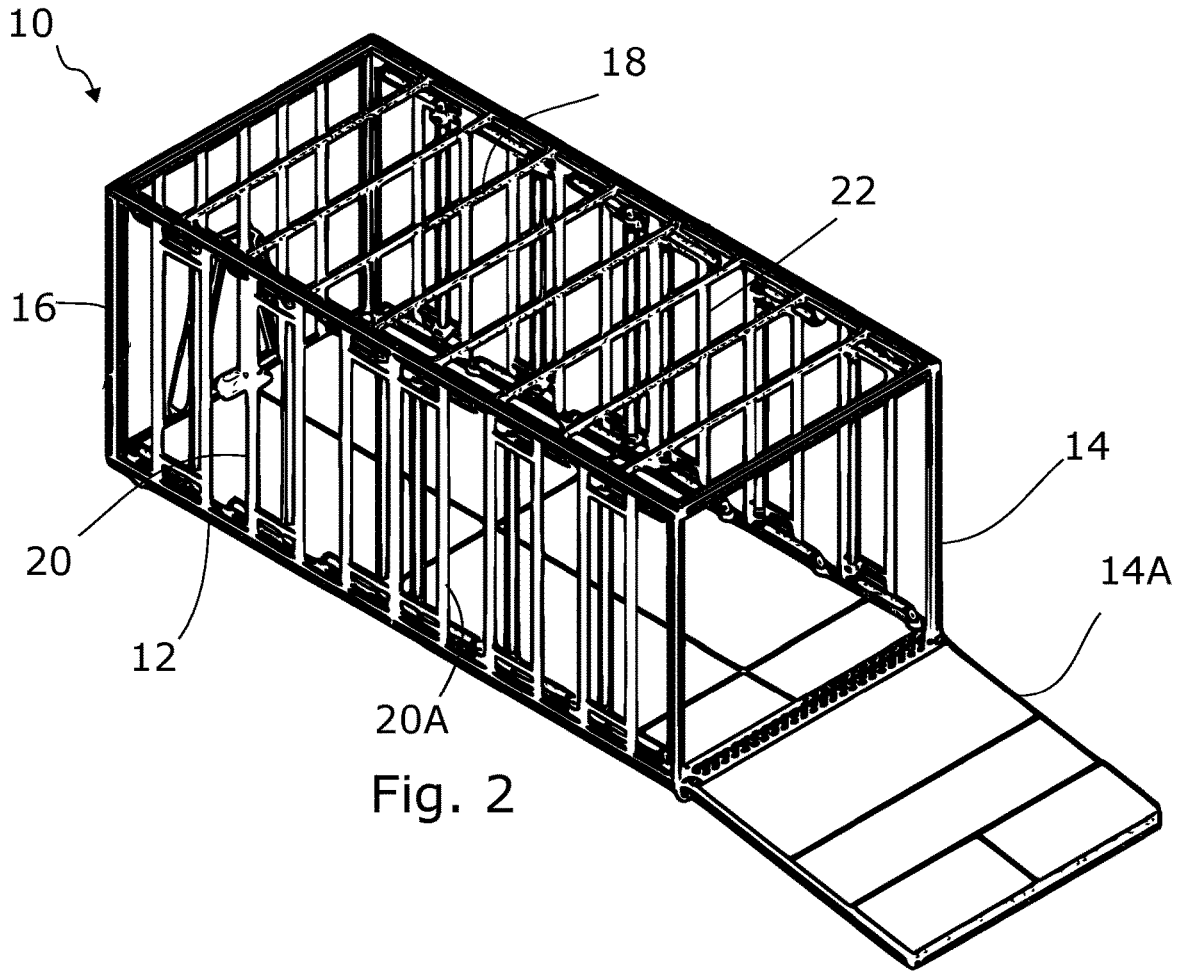
FIG. 2 is a perspective view of an embodiment of an expandable storage container in which the side doors are closed, shown with transparent side doors and ceiling for illustrative purposes.

Immaterial modifications may be made to the embodiments described here without departing from what is covered by the claims. In this description, wherever a connection is described between two components where the connection is used to convey information or commands between the components, those connections may be wired or wireless as appropriate. In general, wiring and electrical power supplies have not been illustrated. The provision of electrical power for components may be determined, as appropriate, according to the requirements of a given embodiment.

As illustrated in FIGS. 1-6, there is disclosed an embodiment of an expandable storage container 10 having a floor 12, a front end 14, a rear end 16, and first and second side walls 20, 22. The storage container 10 has a length defined by a spacing of the front end 14 and rear end 16 and a width defined by a spacing of the first and second side walls 20, 22, the length being larger than the width. The length defines a depth axis of the container. The width defines a horizontal axis of the container.

The front end 14 of the expandable storage container may comprise an end door 14A hingedly connected to the floor 12 or to a ceiling 18 of the expandable storage container via an end door hinge 15. In this document, the term "front end" is used to refer to the end having the end door even if, as is typical, this end is mounted facing rearward on a truck when the container is transported. The first side wall 20 comprises a first side door 20A hingedly connected to the floor 12 via a floor side door hinge 24 defining a vertical axis. The first side door 20A and the end door 14A meet when the expandable storage container 10 is in a closed configuration. When the expandable storage container 10 is in an open configuration, the first side door 20A and the end door 14A open to collectively define a single opening.

The single opening provides a widened opening for a vehicle to enter the expandable storage container. The first side door 20A may extend a distance down the first side wall 20 to provide a widened entry down that length of the first side wall. In an embodiment (not shown), a single side door 20A may extend the entire length of the first side wall 20.

Figure 6:
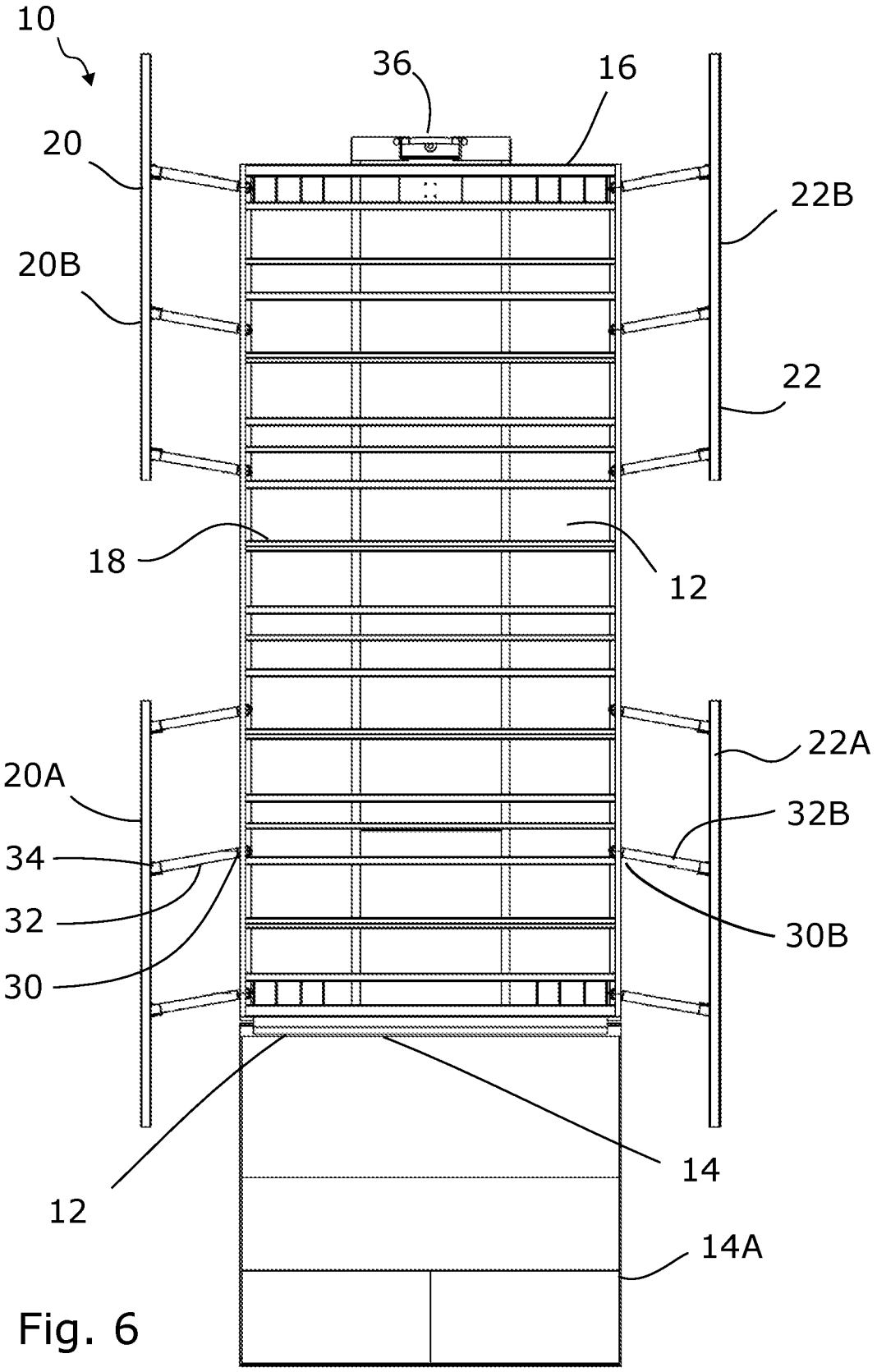
FIG. 6 is a top view of the expandable storage container of FIG. 1.

The first side wall 20 may comprise multiple side doors, as illustrated in FIG. 6. For example, the first side wall 20 may comprise two or more side doors 20A, 20B, each side door connected to swing outward from the floor 12. The multiple side doors when closed may form together at least a portion of the first side wall 20 without any intervening fixed frame elements. In such embodiments, the opening of the multiple side doors 20A, 20B may widen the space between the first side wall 20 and the second side wall 22 for most of, or all of, the length of each of the first side wall 20 and the second side wall 22.

In embodiments with multiple side doors, each additional side door may have the same or similar elements to the first side door 20A. For example, as shown in FIG. 1, an additional side door 20B of the first side wall 20 may be hingedly connected to the floor 12 via an additional floor side door hinge 25. While two side doors are shown for first side wall 20, an expandable storage container 10 could be constructed with additional side doors, e.g. 3 or 4 side doors per side wall.

Figure 3:
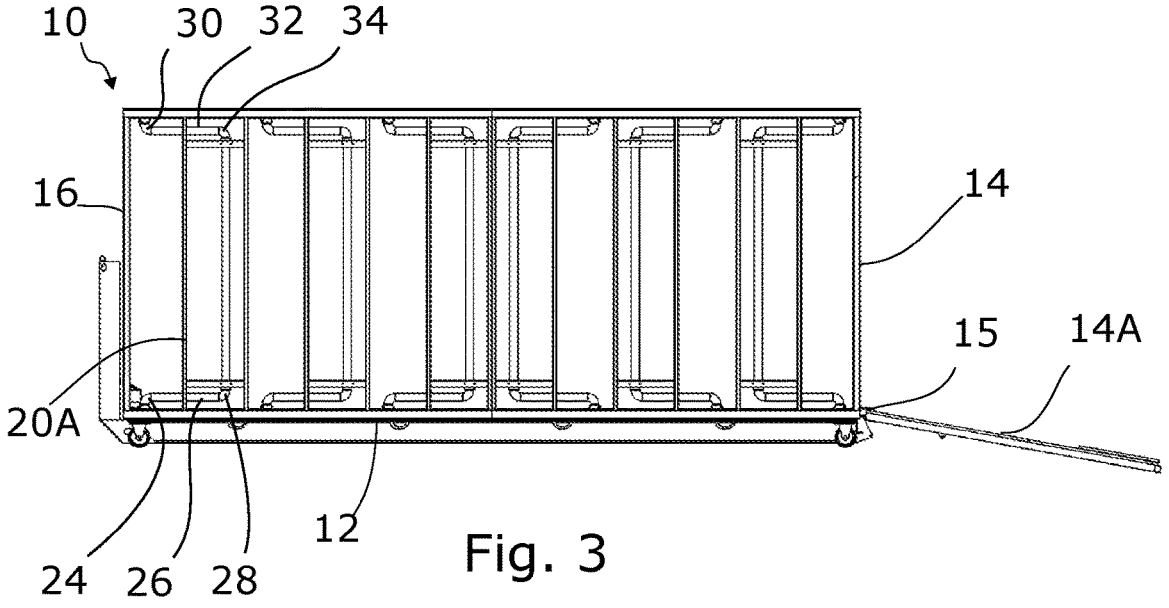
FIG. 3 is a side view of the expandable storage container of FIG. 2.
Figure 4:
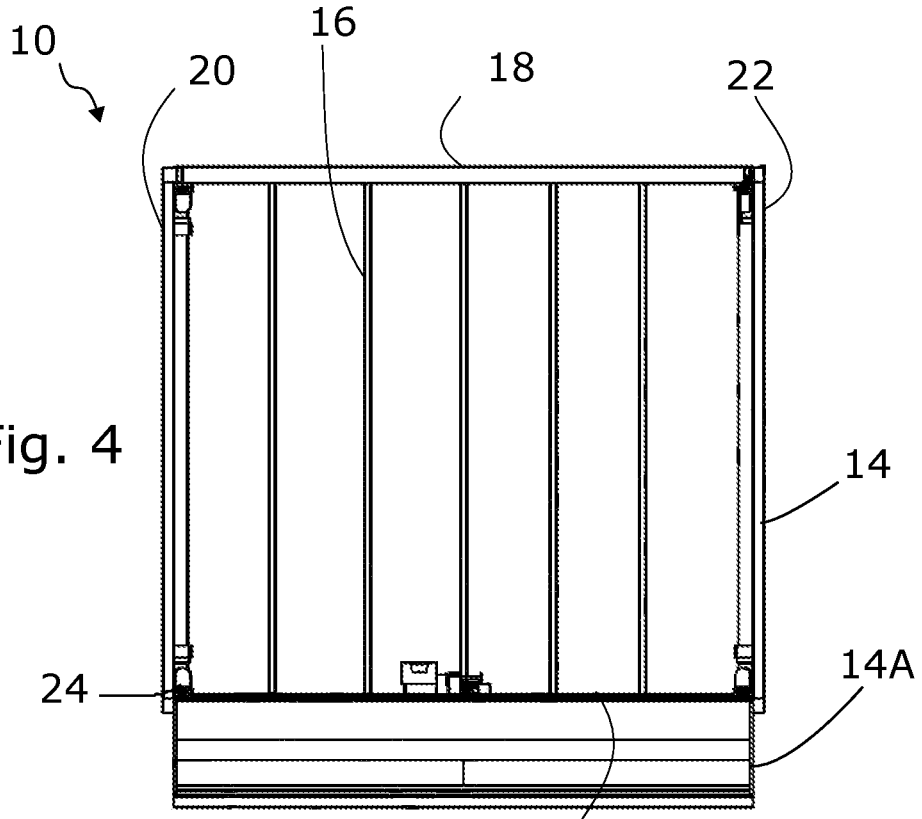
FIG. 4 is a front view of the expandable storage container of FIG. 2.

As shown in FIG. 3, the floor side door hinge 24 may connect to the first side door 20A via a floor swing arm 26 hingedly connected to the first side door via a further hinge 28 defining an axis parallel to the floor side door hinge 24. The floor swing arm 26 may be one of plural floor swing arms connecting the first side door 20A to the floor 12. In embodiments with plural floor swing arms, the floor swing arms may be equal in length and configured to swing synchronously when the first side door 20A is opened.

As shown in FIGS. 3 and 6, the first side door 20A may be hingedly connected to the ceiling 18 via a ceiling side door hinge 30 rotatable about the vertical axis. The ceiling side door hinge 30 may connect to the first side door 20A via a ceiling swing arm 32 hingedly connected to the first side door 20A via another hinge rotatable about the parallel axis. The floor swing arm 26 and ceiling swing arm 32 may be rigidly connected. The floor swing arm 26 may be one of plural floor swing arms connecting the first side door 20A to the floor, and the ceiling swing arm 32 may be one of plural ceiling swing arms connecting the first side door 20A to the floor 12. The swing arms 26, 32 may be equal in length and be configured to swing synchronously when the first side door 20A is opened. The ceiling side door hinge 30 may connect to the first side door 20A via the ceiling swing arm 32 hingedly connected to the first side door 20A via a further hinge 34 defining an axis parallel to the ceiling side door hinge 30.

As shown in FIG. 1, the second side wall 22 may comprise a second side door 22A hingedly connected to the floor 12 via a second floor side door hinge 24B defining a second vertical axis, the second side door 22A and the end door 14A meeting when the expandable storage container is in the closed configuration, and when the expandable storage container is in the open configuration, the first side door 20A, the second side door 22A and the end door 14A opening to collectively define a single opening.

The second side wall 22 may further comprise one or more additional second side doors, such as additional second side door 22B, illustrated in FIG. 1. The one or more additional second side doors when closed may form together at least a portion of the second side wall 22 without any intervening fixed frame elements. The expandable storage container 10 may have bilateral symmetry such that all doors in the first side wall 20 have symmetrically arranged and symmetrically opening counterparts in the second side wall 22. For example, as shown in FIG. 6, a second ceiling side door hinge 30B may connect to the second side door 22A via a second ceiling swing arm 32B hingedly connected to the second side door.

The end door 14A may be hingedly connected to the floor 12 and may be configured to form a ramp when open to connect the floor 12 to a ground surface.

Figure 7:
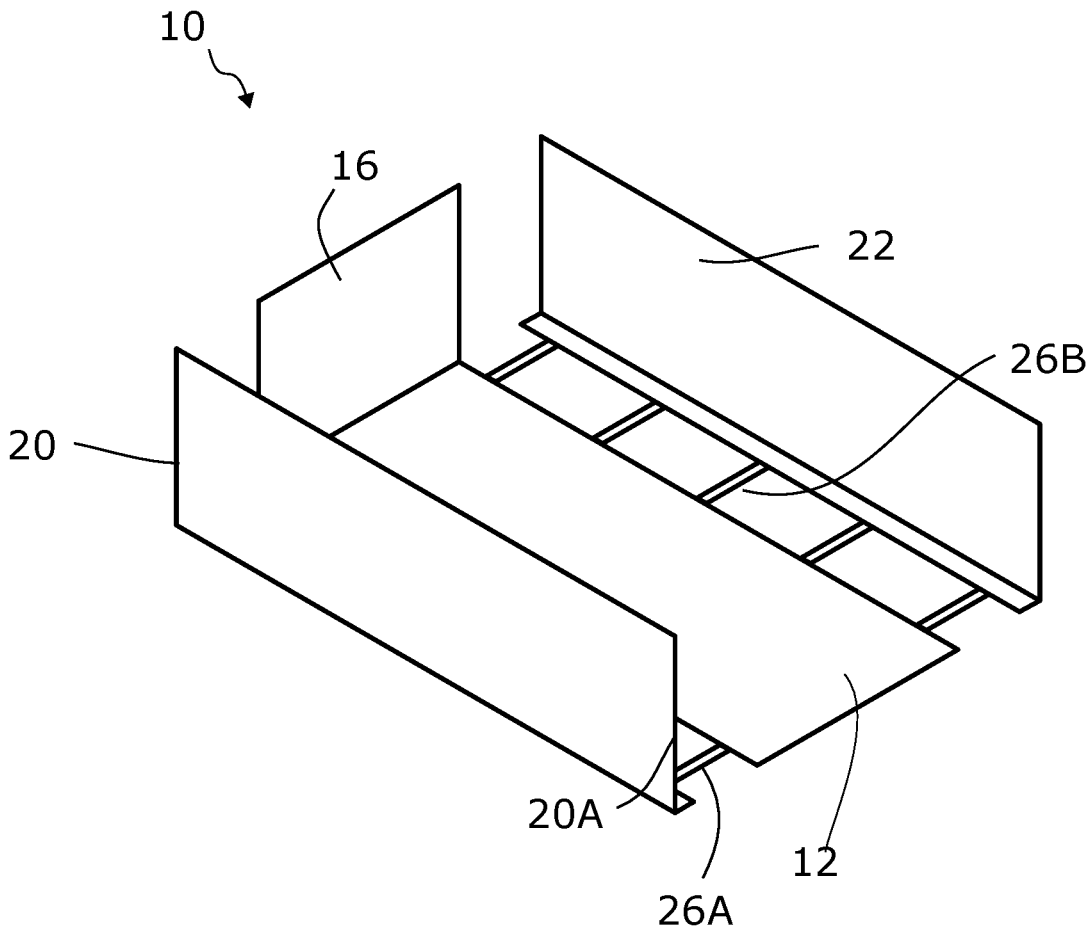
FIG. 7 is perspective view of a further embodiment of an expandable storage container in which the side doors have been opened to expand the width of the expandable storage container.

In an embodiment, as illustrated in FIGS. 1-7, there is disclosed an expandable storage container 10 having a floor 12 and two longitudinal walls 20, 22. Wall 20 has at least one arm 26A and may have a plurality of arms, and wall 22 has at least one arm 26B and may have a plurality of arms. The longitudinal walls 20, 22 are connected through the arms 26A, 26B to the floor 12 so as to provide lateral extension of the longitudinal walls 20, 22 away from the floor 12. As shown in FIG. 7, the arms 26A, 26B are slideably connected to the floor 12 to provide lateral extension. The arms 26A, 26B may alternatively be hingedly connected to the floor 12 to provide lateral extension, as shown in FIG. 1. In these embodiments, each longitudinal wall 20, 22 may have plural arms connecting the longitudinal walls to the floor. Each longitudinal wall 20, 22 may comprise one or more side doors, and these one or more side doors, when closed, form together at least a portion of their respective longitudinal wall without intervening fixed frame elements. The expandable storage container may comprise a ceiling, and the longitudinal walls 20, 22 may be connected through additional ceiling arms to the ceiling, with the same or similar elements to the connection of the floor to the walls. An end door may be hingedly connected to one end of the floor 12 and may be configured to form a ramp when open to connect the floor to a ground surface. The walls 20, 22 may comprise multiple side doors, in which each side door slides outward from the floor 12. The multiple side doors when closed may form together at least a portion of the first side wall 20 without any intervening fixed frame elements. In embodiments with multiple side doors, each additional side door may have the same or similar elements to the other side doors.

In expandable storage containers 10 according to these embodiments, the opening for the vehicle may be opened to a width wider than a closed width of the expandable storage container for the loading and unloading of a vehicle. With other known enclosed trailers or containers, there is the worry about scraping a mirror on the opening or the cables supporting the ramp. In an exemplary embodiment, the opening is 138" wide as compared to 96" if the end door alone were opened.

The increased width provided by the expandable storage container may also permit easier access to the vehicle for securing the vehicle in the trailer. For example, straps may be wound around the tires and affixed to attachment points in the trailer. An expanded opening including expanded walls, as illustrated in FIGS. 1 and 7, provides easy access to a user/operator to secure the straps. The expanded walls also permit the user to open the car door without risking striking a wall of the container.

Figure 5:
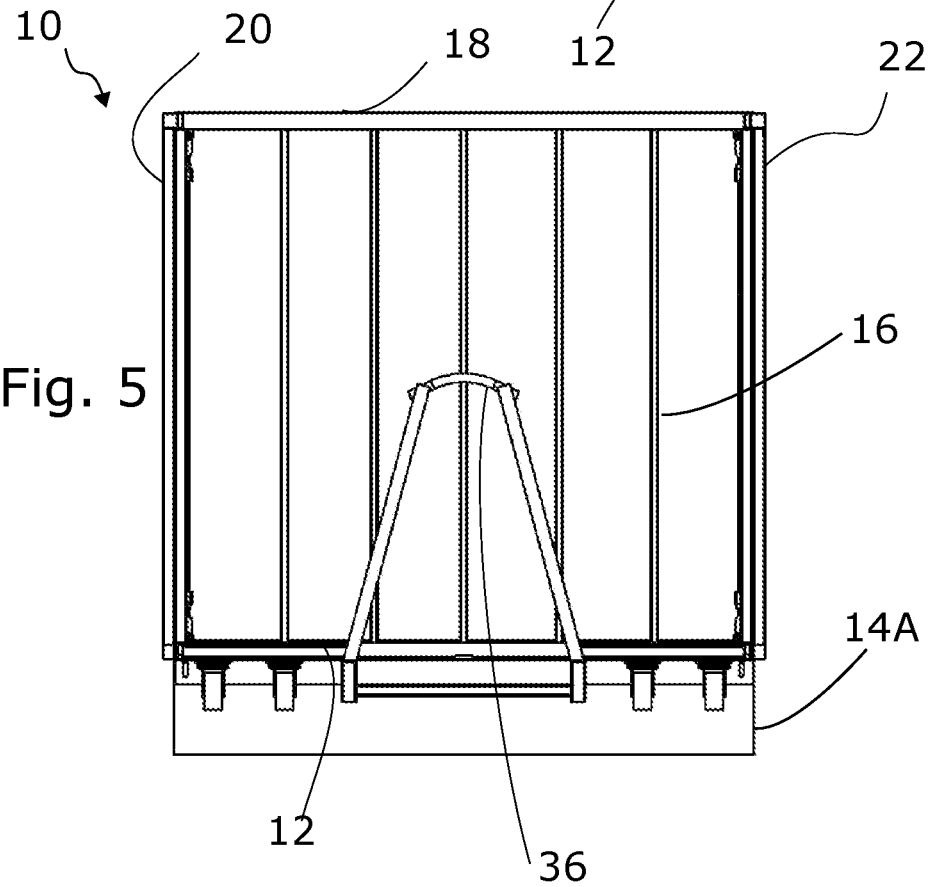
FIG. 5 is a rear view of the expandable storage container of FIG. 2.

The expandable storage container may be used as automobile transport container. For example, the container may be configured to be used with hooklift trucks (and hooklift trailers such as those built by Cam-Concept®), for example using a hooklift connection 36 as shown in FIGS. 5 and 6. The containers may also be usable with Roll-on/Roll-off decks with appropriate adjustments. In embodiments of the expandable storage container, such as that illustrated in FIG. 1, both the walls and the entrance widen for ease and safety of both loading and unloading. The expanded walls provide easy access to the tires for strapping in all four tires without laying down, and the driver's door may open fully without hitting a wall.

The ramp may be designed so that it does not have cables from the roof. Instead, it may have one or more air spring pistons underneath helping to lift the weight of the ramp, so that one person can open or close it alone. The container deck may be designed to have a limited profile, such as having a deck that is only 9" off the ground. The low deck avoids having a sharp incline to the ramp on which a low vehicle may bottom out or scratch a bumper.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An expandable storage container comprising:
fixed frame elements, a front end and two longitudinal walls, the fixed frame elements including a floor;
the longitudinal walls each hingedly connected to one or more arms;
the front end comprising an end door;
each of the one or more arms are hingedly connected to one of the longitudinal walls at a first hinge axis and are connected to the fixed frame elements at a second hinge axis, in which the first hinge axis and second hinge axis for each of the one or more arms are parallel so as to provide lateral extension of the longitudinal walls away from the floor; and in which a first one of the longitudinal walls together with a second one of the longitudinal walls and the end door together define a single opening such that the lateral extension of the first longitudinal wall away from the floor expands the single opening.

2. The expandable storage container of claim 1 in which there are two or more arms connected to each of the longitudinal walls to provide lateral extension.

3. The expandable storage container of claim 1 in which the one or more arms are hingedly connected to the floor to provide lateral extension.

4. An expandable storage container comprising:
a floor, a front end, a rear end, and first and second side walls, the storage container having a length defined by a spacing of the front end and rear end, the length defining a depth axis, and a width defined by a spacing of the first and second side walls, the width defining a horizontal axis, the length being larger than the width;
the front end comprising an end door;
the first side wall comprising a first side door hingedly connected to the floor via a first floor side door hinge between the floor and a floor swing arm, and a second floor side door hinge between the floor swing arm and the first side door, and in which the first floor side door hinge defines a first floor hinge axis and the second floor side door hinge defines a second floor hinge axis parallel to the first floor hinge axis;
the first side door and the end door meeting when the expandable storage container is in a closed configuration, and when the expandable storage container is in an open configuration, the first side door and the end door opening to, with the second side wall, collectively define a single opening, the expandable storage container having a first width in the closed configuration and a second width in the open configuration, wherein the first width is smaller than the second width.

5. The expandable storage container of claim 4 in which the floor swing arm is one of plural floor swing arms connecting the first side door to the floor.

6. The expandable storage container of claim 5 in which the plural floor swing arms are equal in length and are configured to swing synchronously when the first side door is opened.

7. The expandable storage container of claim 4 in which the first side wall further comprises one or more additional side doors, wherein the one or more additional side doors are each hingedly connected to the floor via a respective floor side door hinge, and wherein the one or more additional side doors when closed forming together at least a portion of the first side wall.

8. The expandable storage container of claim 4 comprising a ceiling.

9. The expandable storage container of claim 8 in which the end door is hingedly connected to the floor or to the ceiling of the expandable storage container via an end door hinge.

10. The expandable storage container according to claim 8, the first side door being hingedly connected to the ceiling via a first ceiling side door hinge between the ceiling and a ceiling swing arm, and a second ceiling side door hinge between the ceiling swing arm and the first side door, and in which the first ceiling side door hinge defines a first ceiling hinge axis and the second ceiling side door hinge defines a second ceiling hinge axis parallel to the first hinge axis, both of which are parallel with the first floor hinge axis and the second floor hinge axis.

11. The expandable storage container of claim 10 in which the floor swing arm and ceiling swing arm are rigidly connected.

12. The expandable storage container of claim 10 in which the ceiling swing arm is one of plural ceiling swing arms connecting the first side door to the floor.

13. The expandable storage container of claim 12 in which the swing arms are equal in length and are configured to swing synchronously when the first side door is opened.

14. The expandable storage container of claim 4 in which the first side wall further comprises one or more additional side doors, wherein the one or more first additional side doors are each hingedly connected to the floor via a respective floor side door hinge, and wherein the one or more additional side doors when closed forming together at least a portion of the first side wall without any intervening fixed frame elements.

15. The expandable storage container of claim 4 in which the second side wall comprises a second side door hingedly connected to the floor via a second floor side door hinge defining a second vertical axis, the second floor side door and the end door meeting when the expandable storage container is in the closed configuration, and when the expandable storage container is in the open configuration, the first side door, the second floor side door and the end door opening to collectively define a single opening.

16. The expandable storage container of claim 4 having bilateral symmetry such that all doors in the first side wall have symmetrically arranged and symmetrically opening counterparts in the second side wall.

17. The expandable storage container of claim 4 in which the end door is hingedly connected to the floor, and is configured to form a ramp when open to connect the floor to a ground surface.

* * * * *